US010679527B2

(12) United States Patent
Porzio

(10) Patent No.: US 10,679,527 B2
(45) Date of Patent: Jun. 9, 2020

(54) ROTATING MESSAGE PANEL APPARATUS

(71) Applicant: Thomas Porzio, North Chesterfield, VA (US)

(72) Inventor: Thomas Porzio, North Chesterfield, VA (US)

(73) Assignee: FANASIT LLC, North Chesterfield, VA (US)

( * ) Notice: Subject to any disclaimer, the term of this patent is extended or adjusted under 35 U.S.C. 154(b) by 0 days.

(21) Appl. No.: 16/531,816

(22) Filed: Aug. 5, 2019

(65) Prior Publication Data

US 2020/0051465 A1 Feb. 13, 2020

Related U.S. Application Data

(60) Provisional application No. 62/717,580, filed on Aug. 10, 2018.

(51) Int. Cl.
*G09F 7/22* (2006.01)
*G09F 17/00* (2006.01)

(52) U.S. Cl.
CPC ..... *G09F 7/22* (2013.01); *G09F 2017/0075* (2013.01)

(58) Field of Classification Search
CPC ..... G09F 2017/005; G09F 2017/0075; G09F 21/046
USPC ..... 40/422, 608; 248/289.31
See application file for complete search history.

(56) References Cited

U.S. PATENT DOCUMENTS 1,672,134 A 2/1927 Pitt et al.
2,186,241 A * 1/1940 Glasgow ..... G09F 7/22 248/289.31
3,715,821 A 2/1973 Hawes
4,881,707 A 11/1989 Garfinkle
5,301,446 A * 4/1994 Kurtz ..... G09F 7/22 40/422
5,524,857 A 6/1996 Eisenberg et al.
6,202,334 B1 * 3/2001 Reynolds ..... G09F 7/18 40/608
6,698,124 B2 3/2004 Kump et al.
7,066,105 B2 6/2006 Tal
7,284,740 B2 10/2007 Padiak et al.
(Continued)

FOREIGN PATENT DOCUMENTS

CA 2132246 A1 3/1996
GB 2501097 A 10/2013

OTHER PUBLICATIONS

International Search Report and Written Opinion for PCT Appl. No. PCT/US2019/045232, dated Oct. 29, 2019, 11 pages.

*Primary Examiner* — Joanne Silbermann
(74) *Attorney, Agent, or Firm* — Patent Law of Virginia, PLLC; Brian J. Teague

(57) ABSTRACT

This rotating message panel apparatus relates to a rigid panel that allows for printed indicia or bumper-type stickers to be placed on a vehicle in a manner that that is quickly and easily mounted or removed without marking or damaging the message panel or the vehicle. The message panel rotates to allow for viewing the message primarily from the sides when the vehicle is in motion and primarily from the rear/front when the vehicle is at rest. The controlled rotating action draws greater attention to the message. When employing bumper-type stickers, the message panel allows for changing the message as desired.

24 Claims, 10 Drawing Sheets

(56) References Cited

U.S. PATENT DOCUMENTS

| | | | | |
|---|---|---|---|---|
| 7,878,139 | B1 | 2/2011 | Karnes et al. | |
| 8,297,216 | B1 | 10/2012 | Janton | |
| 9,368,050 | B2 | 6/2016 | Bigham et al. | |
| 2005/0199176 | A1 | 9/2005 | Orton et al. | |
| 2010/0018095 | A1* | 1/2010 | Molla | G09F 7/22 40/606.16 |
| 2012/0260842 | A1* | 10/2012 | King | G09F 17/00 116/174 |
| 2018/0090036 | A1* | 3/2018 | Barnes | G09F 23/06 |

* cited by examiner

ROTATING MESSAGE PANEL APPARATUS

CROSS-REFERENCE TO RELATED APPLICATIONS

This application claims priority to U.S. Provisional Application Ser. No. 62/717,580, filed Aug. 10, 2018, the contents of which are incorporated herein by reference in its entirety.

FIELD OF THE INVENTION

This invention relates to apparatuses for mounting and displaying messages on motor vehicles, on freestanding objects such as mailboxes, or in independently fixed settings.

BACKGROUND

There are a multitude of messaging devices designed to be mounted on vehicles for display while traveling. The market is very crowded with these devices, many of them being cloth flags mounted on plastic poles clipped to the vehicle window. Flags are primarily viewable from the sides of the vehicle when the vehicle is in motion, as flags collapse when the air force is reduced as the vehicle slows and stops. The flags tend to whip to such an extent that the displayed image is distorted when the vehicle is in motion and the flag gets damaged over time. What is needed is a method for clearly displaying messages when the vehicle is in motion or at rest, and one that resists damage during typical use.

There are a multitude of adhesively affixed message media designed to be mounted on vehicles to display messages while traveling or at rest. The market is very crowded with traditional bumper stickers and apparatus for indirectly mounting the stickers to vehicles by mounting stickers on panels that are affixed to the vehicle with suction cups, magnets and other means. What is needed is a method of displaying sticker messages without damaging or marking the vehicle, that is quickly and easily mounted, can be displayed periodically as desired, and that attracts the attention of the public.

There are a number of vehicle-mounted signs/displays where the rotation of the device is intended to draw attention to the displayed message. Many of them are cloth-type flags that whip as a result of air forces. Others are rigid flags that spin or rotate in a random or uncontrolled manner. What is needed is a method of inducing and controlling rotation in a manner that both draws attention to and maximizes presentation of the message. The rotation of the apparatus also needs to be designed so as not to damage the apparatus, excessively vibrate, or mark the vehicle.

The majority of vehicle-mounted signs/displays contain one image or message requiring that any change in the desired message requires purchase of a new sign/display. What is needed is apparatus that allows for changing the message as desired.

The growing vehicle display market has long sought a display apparatus that allows drivers to express themselves with messages that draw attention to their interest or cause, can be displayed intermittently as desired, and does not damage or mark the vehicle.

BRIEF SUMMARY OF THE DISCLOSURE

A device for displaying indicia thereon comprises a base, a pole affixed to or integral with and projecting upward from the base, and a panel hingedly attached to the pole. The panel has opposing sides for receiving indicia on one or both opposing sides. The panel is rotatable about the pole between a first position and a second position. The panel is biased toward the first position when the panel is in the second position or between the first position and the second position.

The panel may comprise a panel stop projecting from the panel. The base may comprise a first base stop projecting from the base. The panel stop may contact the first base stop when the panel moves to the first position to stop the panel from moving past the first position in a direction opposite from the second position. The panel may be rotatable about the pole between a third position and a fourth position. The panel may be biased toward the third position when the panel is in the fourth position or between the third position and the fourth position. The panel stop may contact the first base stop when the panel moves to the third position to stop the panel from moving past the third position in a direction opposite from the fourth position. The base may further comprise a second base stop projecting from the base. The panel stop may contact the second base stop when the panel moves to the second position to stop the panel from moving past the second position in a direction opposite from the first position. The base may further comprise a third base stop projecting from the base. The panel stop may contact the third base stop when the panel moves to the fourth position to stop the panel from moving past the fourth position in a direction opposite from the third position.

The device may further comprise a hollow tube affixed to or integral with the panel for receiving the pole to enable attachment of the panel to the pole. A bottom end of the tube may be angled and a surface of the base is angled such that the angle of the tube cooperates with the angled surface of the base to move the panel upward as the panel moves from the first position to the second position or from the third position to the fourth position. The upward movement of the panel may bias the panel toward the first position or toward the third position.

A reduced diameter area may be defined in a portion of the pole adjacent a top end of the pole. A top end of the tube may comprise a ledge closing off a portion of the top end of the tube. The ledge may engage with the reduced diameter area of the pole to retain the panel in place attached to the pole.

The panel stop may project downward from a bottom edge of the panel. The first base stop may project outward from the base.

The base may comprise a clip adapted to enable the device to be mounted to a top edge of a vehicle window.

A distal edge of the panel may be tapered or thinned.

In alternative embodiments of the invention, a method for displaying indicia on a motor vehicle comprises (a) obtaining a device for displaying indicia thereon as described above, (b) attaching the clip to the top edge of the motor vehicle window, and (c) positioning the panel into the first position if the motor vehicle window is on a first side of the vehicle or positioning the panel into the third position if the motor vehicle window is on a second side of the vehicle opposite from the first side.

BRIEF DESCRIPTION OF THE SEVERAL VIEWS OF THE DRAWINGS

The foregoing summary, as well as the following detailed description of the disclosure, will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown. In the drawings.

DETAILED DESCRIPTION OF THE DISCLOSURE

Figure 1:
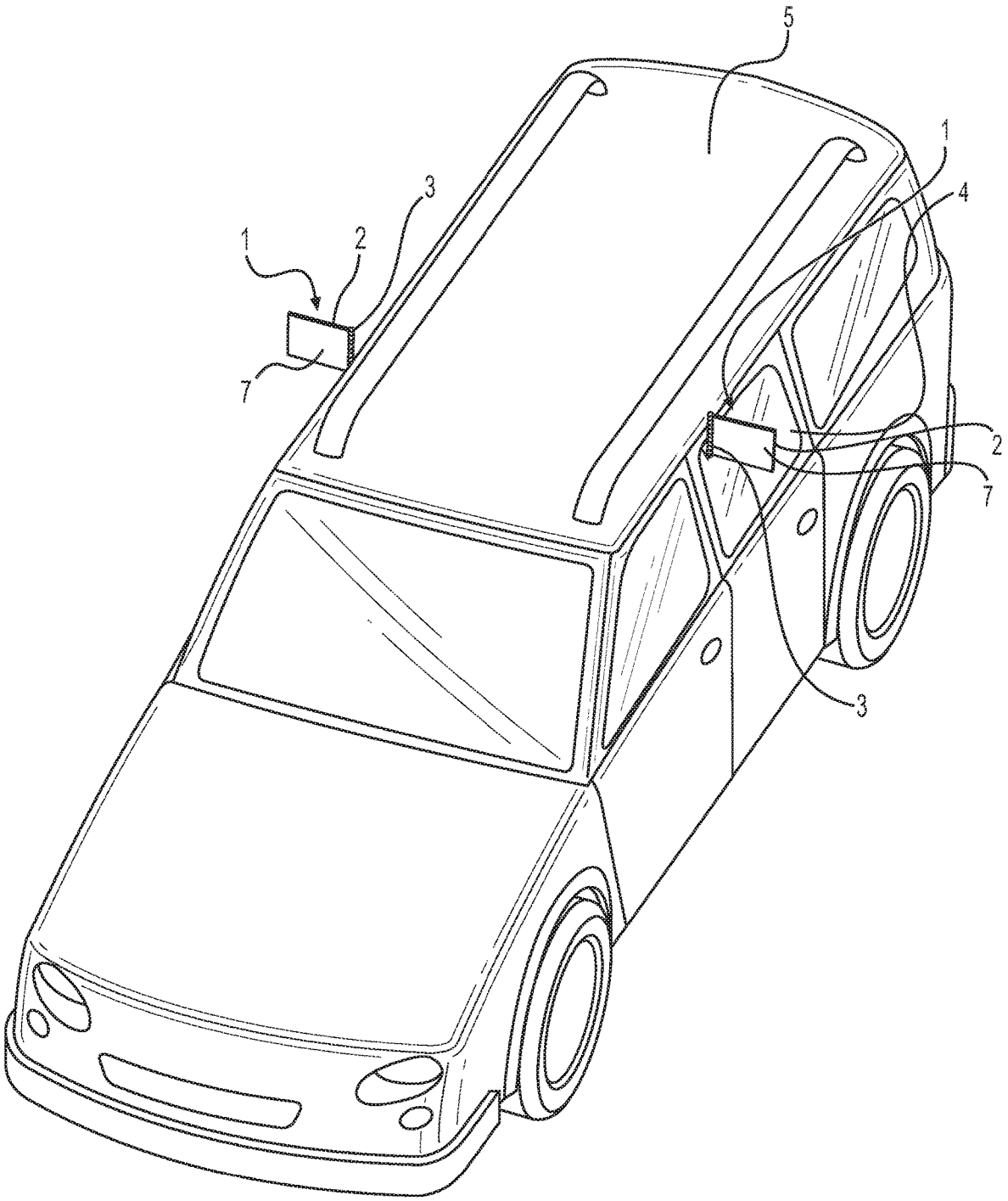
FIG. 1 is a front, perspective view of a rotating message panel apparatus mounted on a vehicle at rest, in accordance with embodiments of the invention.

Certain terminology is used in the following description for convenience only and is not limiting. The words "lower," "bottom," "upper," and "top" designate directions in the drawings to which reference is made. The words "inwardly," "outwardly," "upwardly" and "downwardly" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

A rotating message panel apparatus of embodiments of the invention enables drivers to customize their message, display the message only when desired, and readily change the message when desired. The message apparatus of embodiments of the invention may be preprinted or blank. The apparatus is configured to accommodate placement of bumper-type stickers over any pre-printed panel or on a blank panel. The rotation of the message panel draws attention to enable the message to be viewed while the vehicle in motion or at rest.

Several advantages of this new message apparatus are that it is reusable, does not leave marks on the vehicle, and can be displayed intermittently as desired. This apparatus feeds the desire of drivers to be creative and to communicate with others.

Detailed descriptions of the invention will focus primarily on the mounting and displaying of the apparatus on motor vehicles; however, it is understood that the invention applies more broadly and is not limited to such vehicle-mounted versions. The message is displayed while the apparatus is in a static default position or in a second position resulting from air or wind forces.

Embodiments of the invention are for mounting and displaying messages on motor vehicles in a manner that is quickly and easily placed on or taken off the vehicle. The apparatus is designed to display messages periodically and does not mark or damage the vehicle or the message as the apparatus is repositioned. Repositioning and remounting features of the apparatus allow for displaying messages only when desired and for changing the messages as desired.

Figure 2:
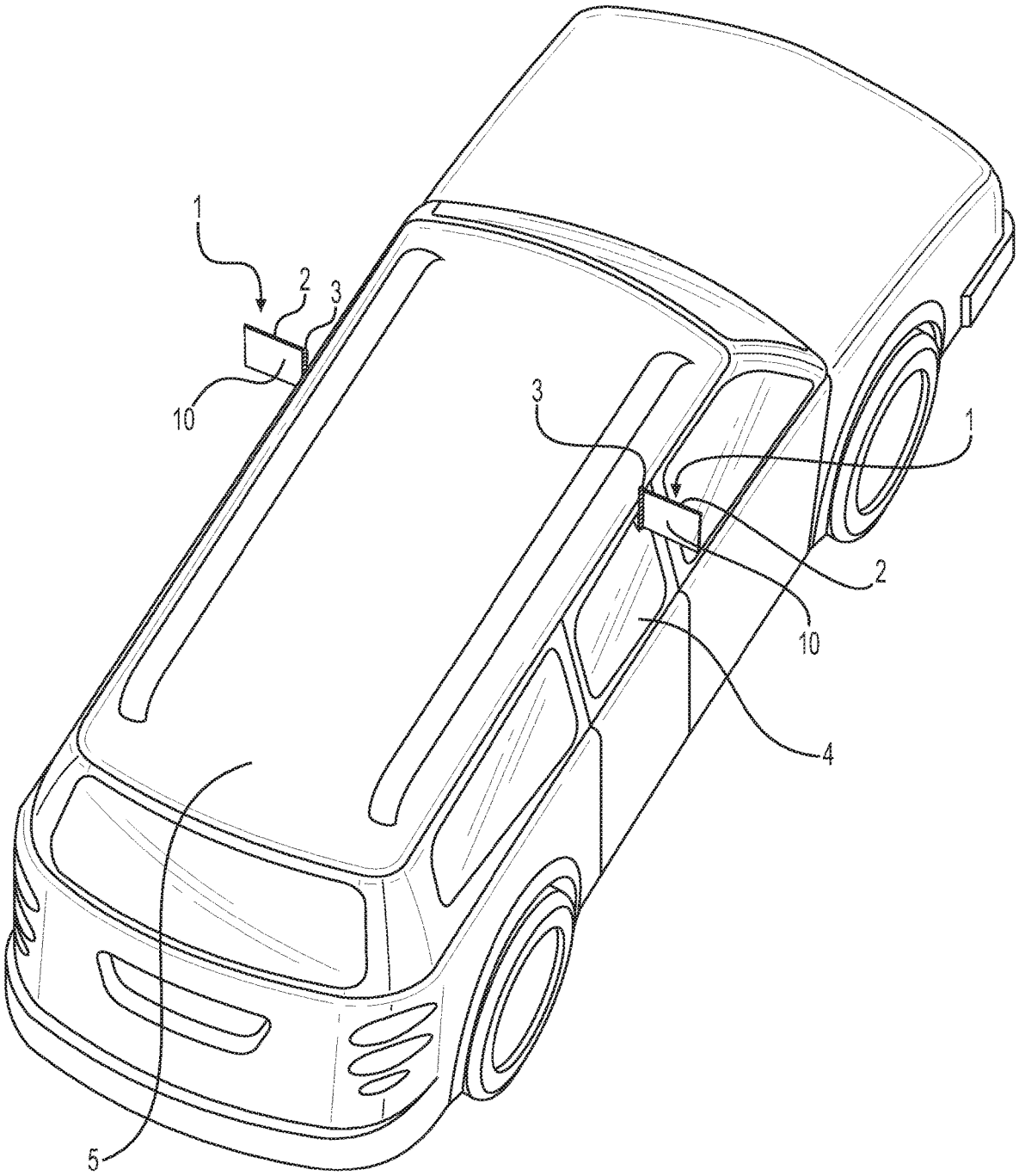
FIG. 2 is a rear, perspective view of the apparatus of FIG. 1 mounted on a vehicle at rest.
Figure 3:
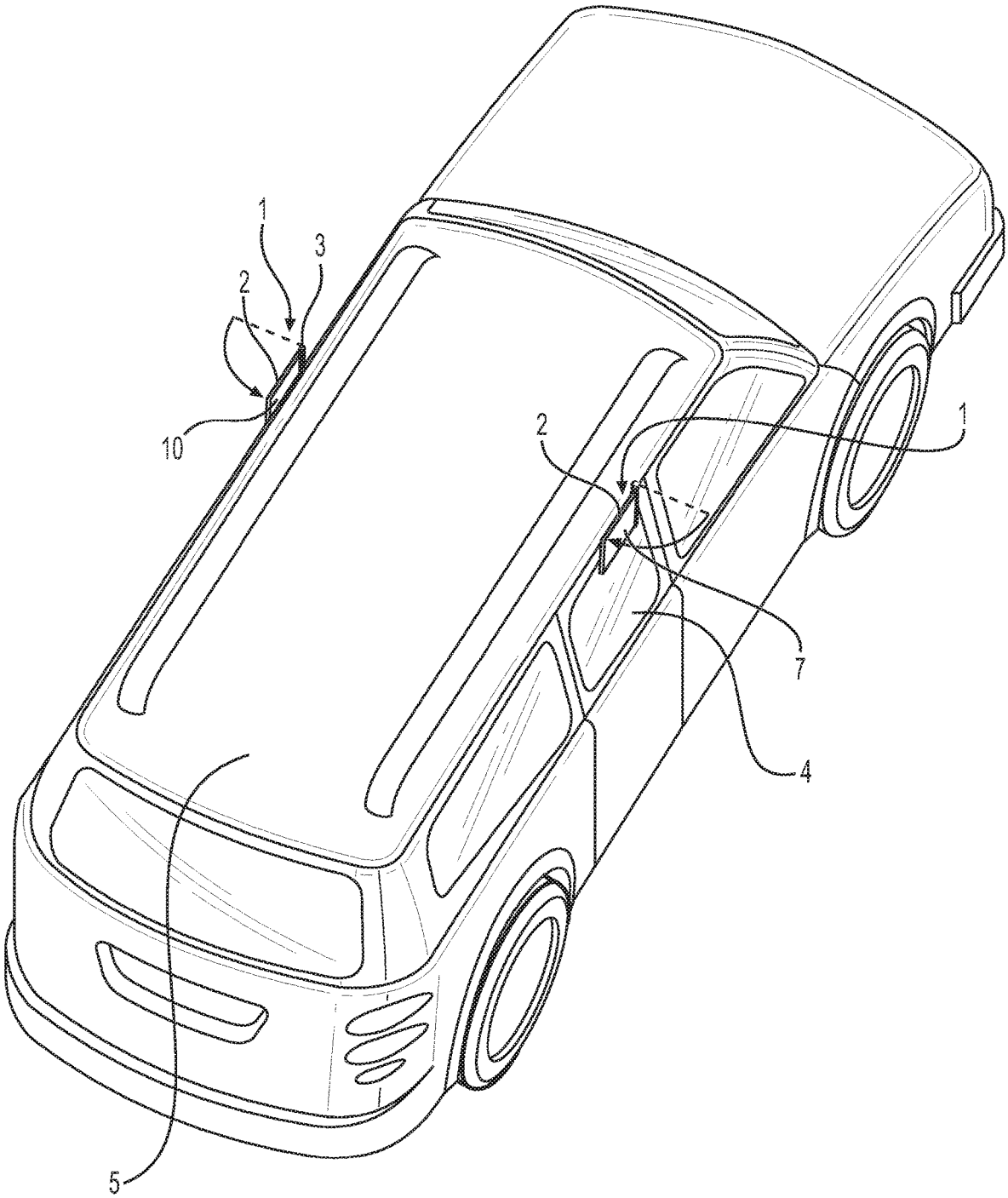
FIG. 3 is a rear, perspective view of the apparatus of FIG. 1 mounted on a vehicle in motion.

Referring to the figures of the drawings, wherein like numerals of reference designate like elements throughout the several views, FIG. 1 provides a front perspective view of an apparatus 1 mounted to each side of a motor vehicle 5, while FIG. 2 provides a rear perspective view thereof. The two apparatuses 1 shown on opposing sides of the vehicle 5 in FIGS. 1-3 are identical, but are mounted in mirror-image arrangements on the vehicle 5. The apparatus 1 comprises a message panel 2 and mounting pole 3 clipped to a window 4 on a stationary vehicle 5. The message panel is shown in FIGS. 1 and 2 in a first position generally perpendicular to the side of vehicle 5 with front sides 7 of message panels 2 displayed toward vehicles/people viewing the vehicle 5 from the front and the rear sides 10 of the message panels 2 displayed toward vehicles/people viewing the vehicle 5 from the rear. The term "front side 7" is used to describe the forward-facing side of each panel when each panel is in its first position (regardless of which side of the vehicle to which the apparatus 1 is mounted). The term "rear side 10" is used to describe the rearward-facing side of each panel when each panel is in its first position (regardless of which side of the vehicle to which the apparatus 1 is mounted). Because the two apparatuses 1 are identical, the front side of a panel on one side of the vehicle would be the rear side of the panel on the opposite side of the vehicle, and vice versa.

The message panel 2 assumes/maintains the first position when the vehicle is not in motion or is moving slowly, such that any indicia on the message panel 2 is viewable from vehicles behind and in front of the vehicle 5 (assuming indicia is on both sides of the message panel 2). As described below, the message panel 2 is biased toward the first position such that the message panel 2 returns to the first position shown in FIGS. 1 and 2 after the vehicle stops moving or slows down enough after moving more quickly.

The message panel is shown in FIG. 3 in a second position generally parallel to the side of vehicle 5 with front sides 7 of message panels 2 displayed toward vehicles/people viewing the vehicle 5 from the sides (the rear sides 10 of the message panels 2 are less visible or not visible when in the second position). The message panel 2 is moved from the first position to the second position by the relative wind force resulting from the forward motion of the vehicle. The automatic movement of the message panel 2 from the first position to the second position occurs when the vehicle is moving fast enough such that the relative wind force overcomes the biasing of the message panel 2 toward the first position. The relative wind force, and therefore the vehicle speed, that is needed to overcome the biasing of the message panel toward the first position and therefore to move the message panel 2 into the second position depends on the specific design of the apparatus. When the relative wind force, and therefore the vehicle speed, is no longer enough to overcome the biasing of the message panel toward the first position, the message panel returns to the first position.

Additionally, the range of panel rotation of the apparatus is depicted in FIG. 3 which shows two apparatus of the same manufacture, each mounted on opposing sides of a vehicle. The panels 2 rotate about poles 3, beginning generally perpendicular to vehicle 5 from a first position (illustrated by the dashed lines in FIG. 3) while the vehicle is at rest, rotating to a second position while the vehicle is in motion, and rotating back to first position when the vehicle 5 returns to a stationary position.

Figure 4:
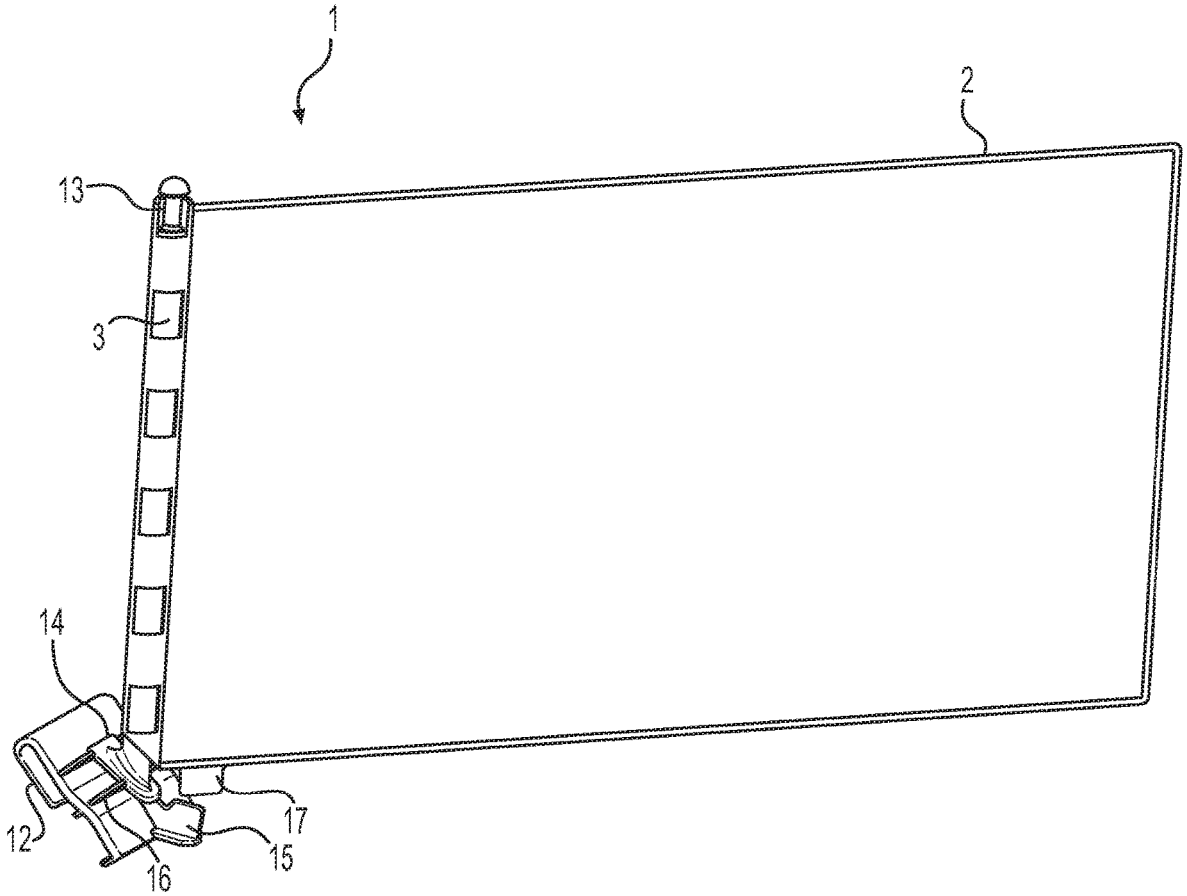
FIG. 4 is a perspective view of a rotating message panel apparatus, in accordance with embodiments of the invention.

FIG. 4 is a perspective view of apparatus 1 comprising a message panel 2 and mounting pole 3. A mounting clip 12 is integral (or, alternatively, affixed) to the mounting pole 3. Integral (or, alternatively, affixed) to the mounting pole 3 and/or the mounting clip 12 are detent 13, sloped panel support surface 14, lower rotation stop 15, and upper rotation stop 16. Panel stop 17 is integral (or, alternatively, affixed) to message panel 2.

Figure 5:
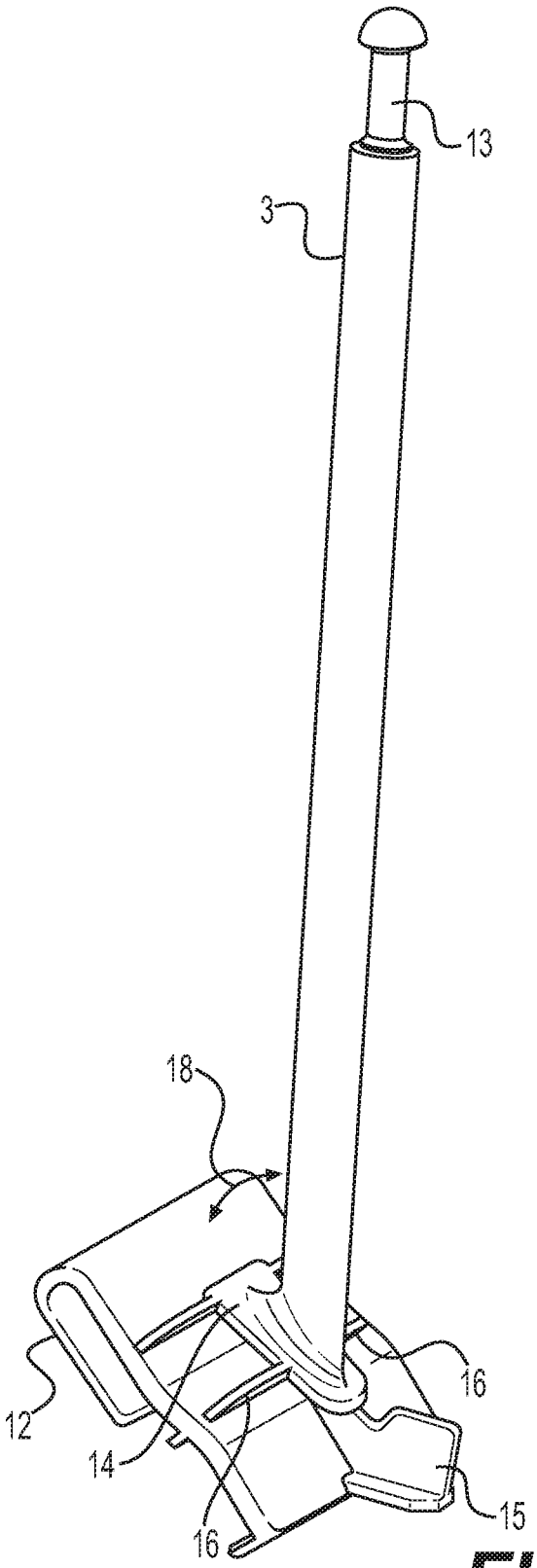
FIG. 5 is a perspective view of the mounting pole of the apparatus of FIG. 4.

The mounting pole 3, mounting clip 12, sloped support surface 14, lower rotation stop 15, upper rotation stops 16, and detent 13 are depicted in FIG. 5 with the message panel 2 removed. Mounting pole 3 intersects mounting clip 12 at acute angle 18. Acute angle 18 is selected such that the mounting pole 3 is generally slanted away from the vehicle when the mounting clip 12 is attached to a vehicle window.

Figure 6:
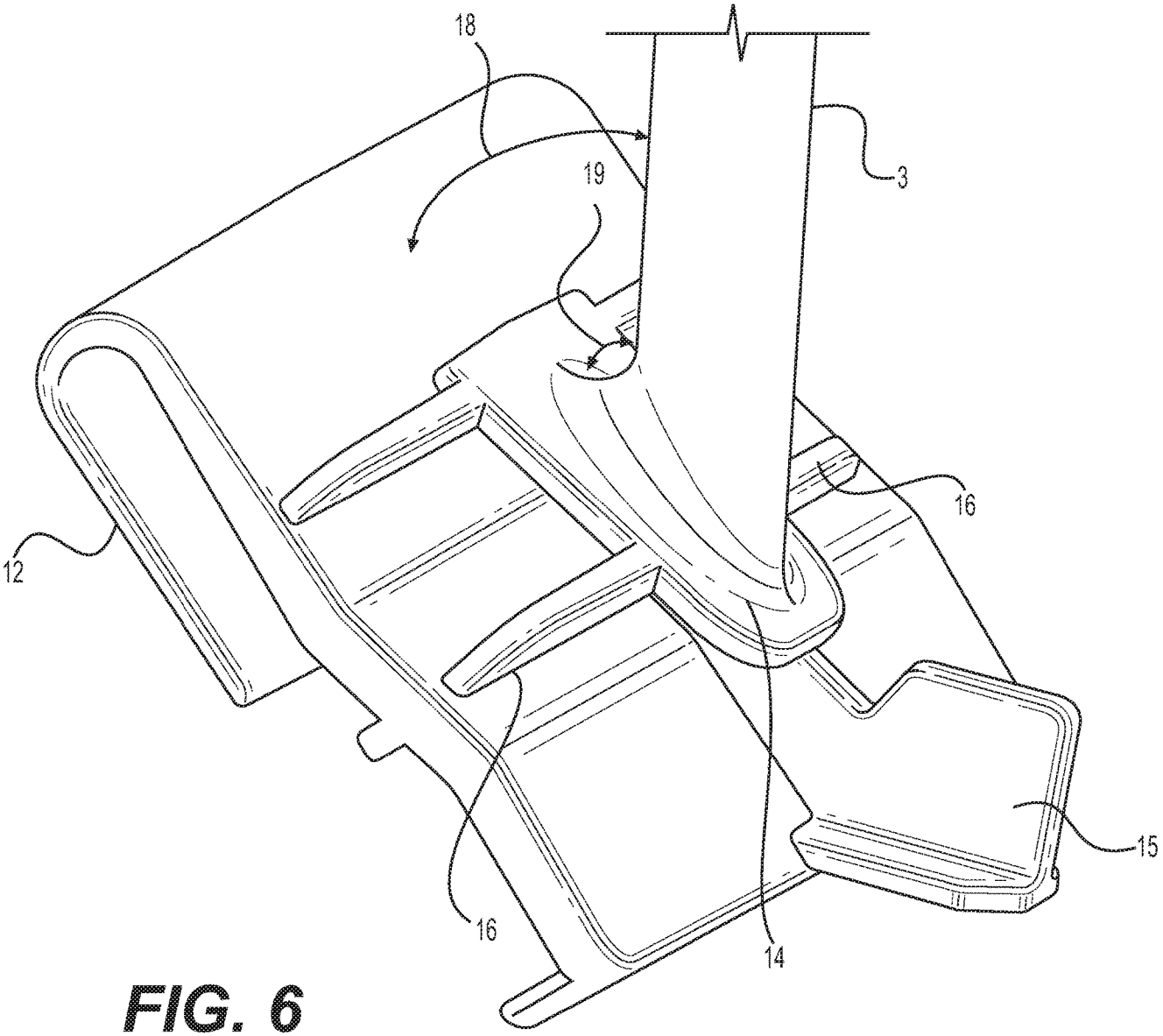
FIG. 6 is an expanded view of the lower part of the mounting pole of FIG. 5.

FIG. 6 provides an expanded view of the J-shaped mounting clip 12, sloped message panel support surface 14 intersecting pole 3 at acute angle 19, lower rotation stop 15, and upper rotation stops 16. Mounting pole 3 intersects sloped panel support surface 14 at acute angle 19.

Figure 7:
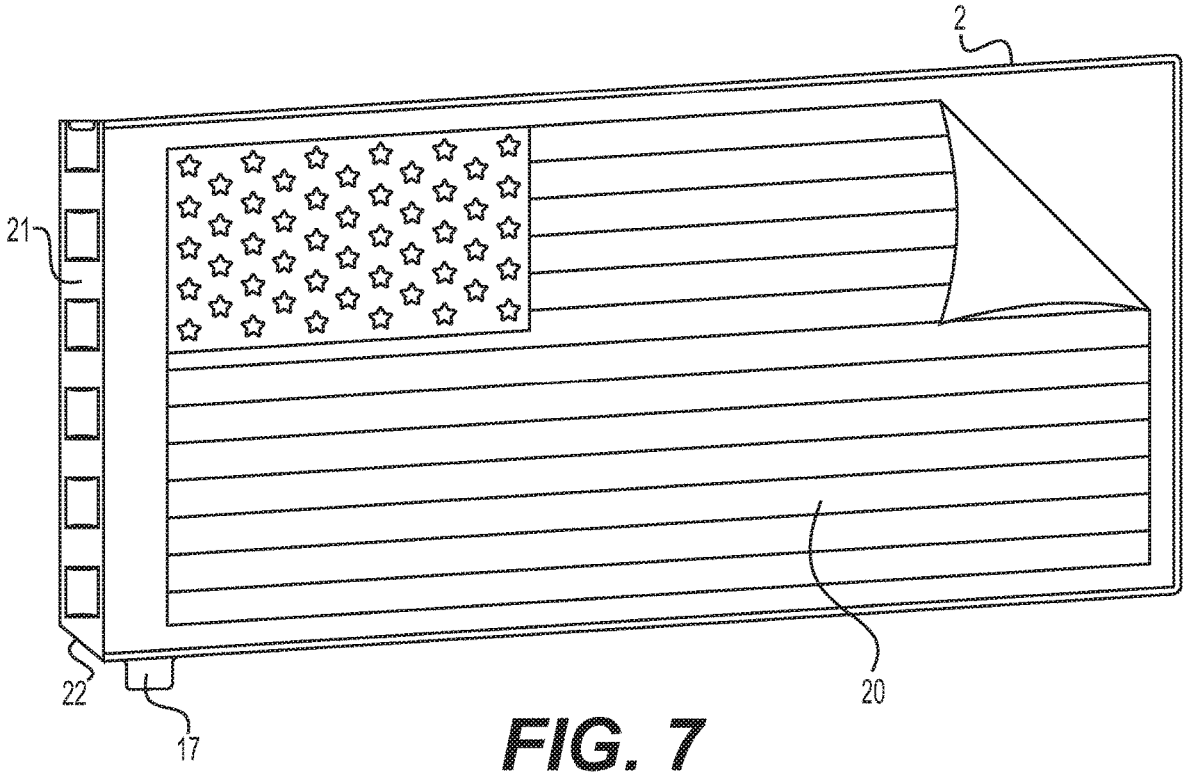
FIG. 7 is a front view of the message panel of the apparatus of FIG. 4, with indicia affixed thereto.

In FIG. 7 indicia 20 is depicted on one side of message panel 2. Panel stop 17 extends from the proximal bottom edge of message panel 2. Substantially tubular feature 21 (which receives pole 3) is angled at base 22. As illustrated, the tubular feature 21 is a generally cylindrical hollow tube for receiving the pole 3. The tubular feature 21 may be integral with or attached to the message panel 2. Other structures may be used to hingedly attach the message panel to the pole. For example, in alternative embodiments of the invention, two or more rings (not illustrated) may be integral with or attached to the message panel to receive the pole. In alternative embodiments of the invention, the extended panel stop 17 may be omitted. In such alternative embodiments, the main body of the message panel 2 itself contacts the lower rotation stop 15 and the upper rotation stop 16 as the panel moves between its different positions.

The message panel 2 is typically generally rectangular in shape, although any suitable shape may be used. As seen in FIG. 7, the bottom and top edges of the message panel 2 may be angled upward (from the proximal end (the end adjacent the tubular feature 21) to the distal end (the right side in FIG. 7)). This angling of the bottom and top edges of the message panel 2 enables the bottom and top edges to be parallel (or roughly parallel) to the ground when the message panel 2 has rotated into the at-rest position perpendicular to the vehicle, due to the pole 3 not being exactly vertical but rather typically having an outward slant away from the side of the vehicle. Similarly, the distal or trailing edge of the message panel 2 (the right side edge in FIG. 7) may be angled inward (from the bottom to the top), such that the bottom edge and distal edge are at approximately 90 degrees.

The distal or trailing edge of the message panel 2 (the right side edge in FIG. 7) may be tapered or thinned, either along its entirety or just near its lower end. Such tapering may be desirable to reduce the likelihood of the trailing edge of the message panel 2 to audibly contact the vehicle when in the in-motion position parallel to the vehicle.

Figure 8:
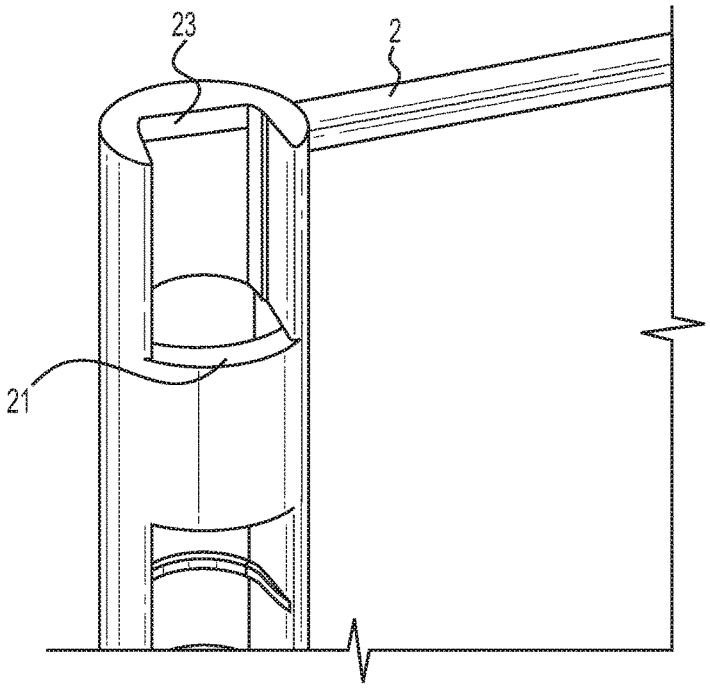
FIG. 8 is an expanded view of the upper end of the tubular section of the message panel of the apparatus of FIG. 4.

An expanded view of the upper end of the substantially tubular feature 21 of panel 2 contains a vertical stop 23, which is a narrowed area at the top end of the tubular feature 21, as depicted in FIG. 8. The vertical stop 23 interacts with the enlarged top end of the pole 3 to keep the message panel 2 from lifting off the pole 3 due to wind pressure when the vehicle is in motion.

Figure 9:
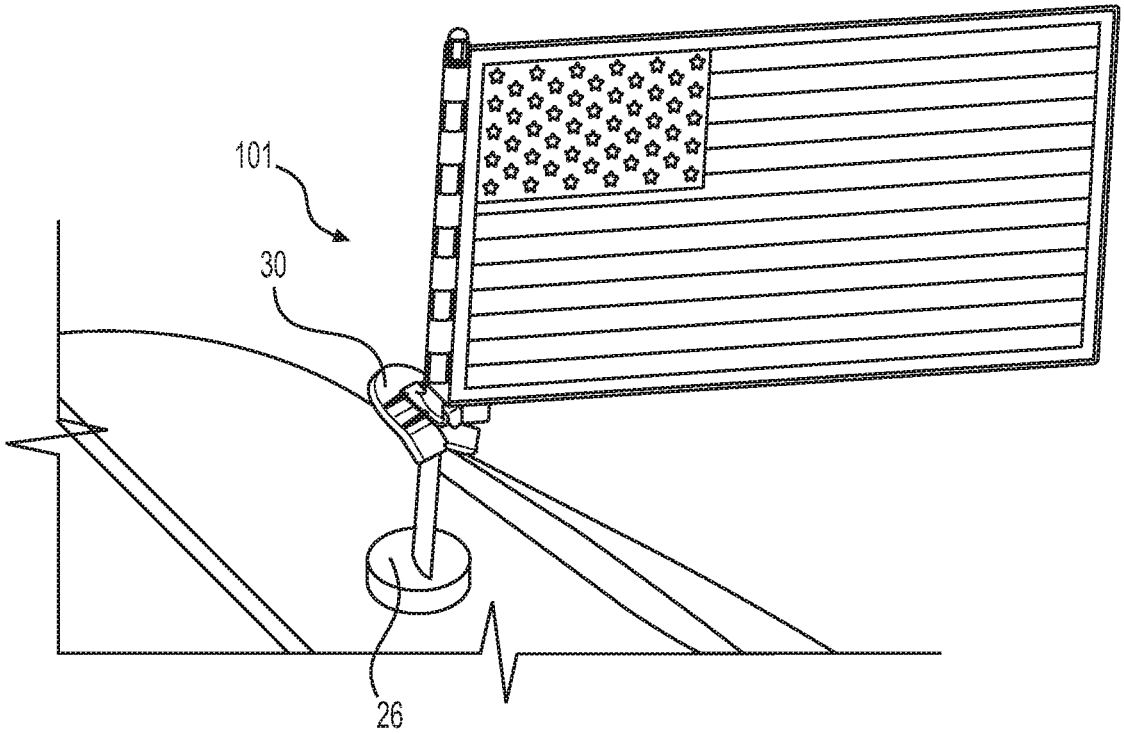
FIGS. 9-12 are perspective views of rotating message panel apparatuses of alternative embodiments of the invention.
Figure 10:
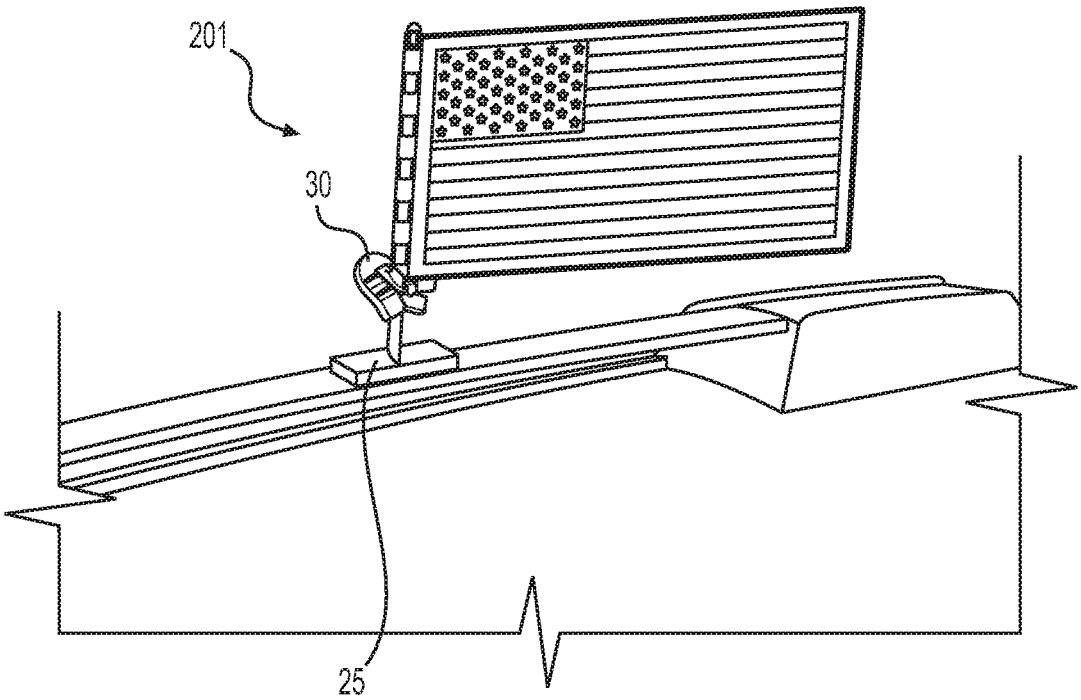
Figure 11:
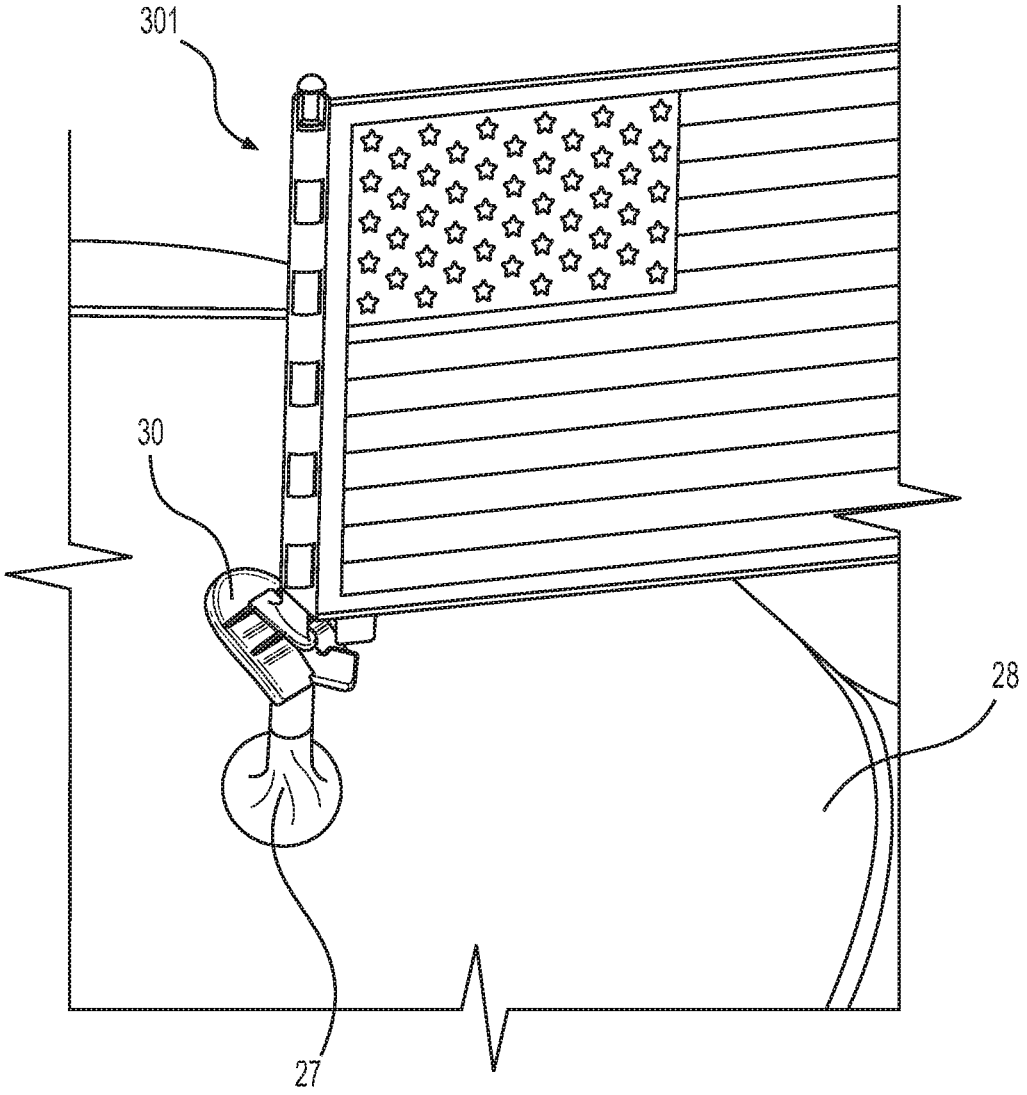

Illustrations of alternative mounting options include mounting of message apparatus 101, 201, and 301 at different locations on a vehicle affixed by various means to include a magnetic mount 26 mounted to a metal surface in FIG. 9, a mechanical mount 25 attached to a roof rack in FIG. 10, and a suction cup 27 mounted to rear window 28 in FIG. 11. An alternative panel support surface 30 may be used instead of clip 12. Although not labeled, alternative panel support surface 30 comprises a sloped panel support surface, a lower rotation stop, and an upper rotation stop, similar to clip 12.

Figure 12:
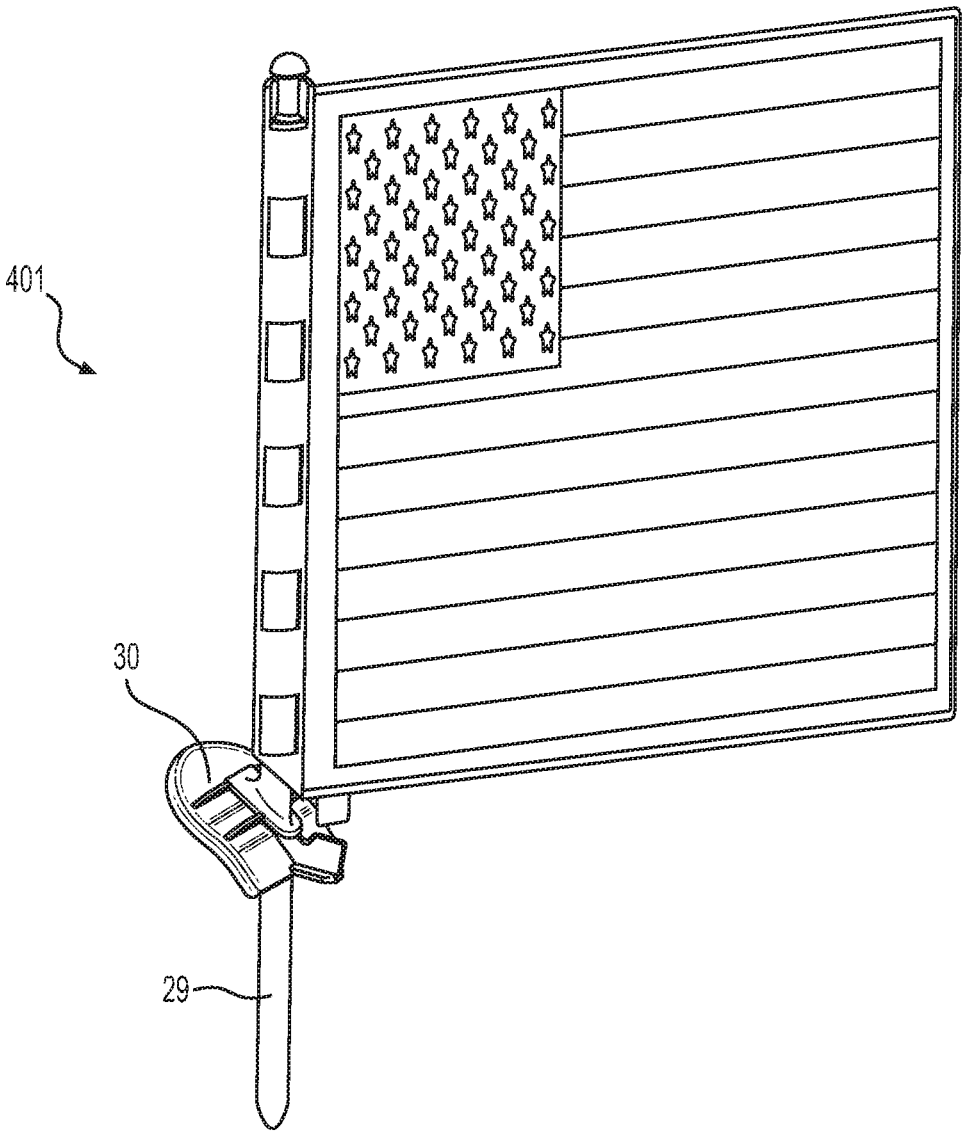

An alternative embodiment of the apparatus in FIG. 12 shows the message apparatus 401 with an elongated tapered mounting pole 29 which may inserted into the ground.

Operation

Steps for assembling, mounting, and using a rotating message panel apparatus 1 of embodiments of the invention are described below. These steps do not necessarily need to be performed in the listed order, some steps may be optional, and some steps may be combined.

Apply Indicia to Message Panel: The message panel 2 may be produced with pre-applied indicia or as a blank ready for application of indicia by the user. The indicia (whether pre-applied or applied by a user) would typically comprise adhesive stickers that are applied to one or both sides of the panel 2. However, any other suitable indicia may be applied to the panel(s), such as indicia that is printed, painted, drawn, or otherwise directly applied on the panel(s). The user may apply indicia created by another and purchased or otherwise obtained by the user, or the user may create his/her own indicia. Indicia may be applied with consideration to a combination of factors, including the side of the panel predominantly displayed when the vehicle is at rest or during vehicle motion, intended relationship between indicia on either side of the panel, and intended relationship between messages on a message panel that may be mounted on the opposing side of the vehicle. One or both sides of the message panel may have pre-applied indicia or may receive application of custom indicia by the user.

Connect Message Panel to Mounting Pole: The message panel 2 may be connected to the mounting pole 3 prior to or after affixing the apparatus 1 to the vehicle. The generally tubular part 21 of the panel 2 is positioned to allow insertion of the pole 3 from the lower end of the tubular panel section 21 toward the upper end, snapping into position as the upper ends of the tubular section 21 and pole 3 meet.

Affix Apparatus to Vehicle: Affix the apparatus 1 to the desired side of the vehicle, and if desired affix a second apparatus on the opposing side of the vehicle. In the embodiment of FIGS. 1-9, the apparatus is affixed to the vehicle by sliding the mounting clip 12 over the top edge of a partially open vehicle window.

Default At-Rest Position: Position the message panel 2 perpendicular to the major axis of the vehicle with the panel stop 17 on the rear-facing side of the lower rotation stop 15 to verify messaging is displayed as intended and test rotation of the message panel 2 toward the rear of the vehicle. The apparatus 1 is now ready for in-motion operation.

In-Motion Position: As the vehicle moves forward the message panel 2 rotates from the default (first, perpendicular) position toward the rear of the vehicle, with the trailing end of the message panel 2 pointing toward the rear of the vehicle. When the message panel 2 has rotated to the point that the panel stop 17 contacts the upper rotation stop 16 (on the trailing side), the upper rotation stop 16 prevents further rotation of the message panel 2 such that the message on the front side of the panel is predominantly viewed from the side of the vehicle while in motion. The upper rotation stops 16 reduce panel 2 contact with the car and stabilize the panel 2 while the vehicle is in motion. The upper rotation stops 16 are on both sides of the mounting pole so that rotation of the message panel 2 can be stopped regardless of which side of the vehicle (driver or passenger) the apparatus 1 is mounted. Additionally, a bend or curve in the panel typically results from wind forces pushing the panel against the upper rotation stop, creating a biasing spring force. The angles of the sloped panel support surface 14 and the angled panel base 22 force the message panel 2 upward as the message panel 2 rotates from its default position. In an alternative embodiment of the invention (not illustrated), the angled panel base 22 may be omitted and the bottom end of the pole may generally horizontal and not angled. In such an alternative embodiment, the sloped panel support surface 14 would be sufficient to force the message panel 2 upward as the message panel 2 rotates from its default position.

Return-to-Rest Position: As the vehicle slows to a stop the message panel 2 returns to the default position as a result of a combination of spring force, momentum, angled panel support surface, angled panel base, and mounting pole angle (as gravity pulls the message panel back downward, the angled surfaces rotate the message panel back to the default position). This forward rotation increases interest in the message panel and the applied message (the motion is eye-catching, with the message viewed from the rear of the vehicle (and from the front of the vehicle if there is indicia on both sides of the message panel) being predominant.

Detaching/Reaffixing Apparatus to Vehicle: Once the vehicle arrives at its destination, the entire apparatus 1 may be quickly and easily removed or detached from the vehicle (or the message panel 2 may be detached from the mounting pole 3). Likewise, the apparatus 1 may be reaffixed as desired prior to returning the vehicle to operation (or the panel 2 may be reaffixed to the mounting pole 3).

Return to Default Operating Position: While the vehicle is stationary, strong wind gusts may overcome stops, allowing the panel 2 to over rotate toward the front of the vehicle (i.e., rotate beyond the 90 degree position), rather than potentially break the apparatus. When the vehicle resumes forward motion, wind force overcomes the stops, returning the panel to the preferred range of motion.

Changing Indicia: The indicia may be changed as desired, either by changing message panels or by applying new messages to original panels, such as by applying new stickers to the panels.

Independent Embodiment: The apparatus may be configured for the message panel to be mounted to a pole affixed to a stationary object, such as a freestanding mailbox. In this configuration the message panel is set in motion by the wind, with return to the default position as the wind direction changes or its force subsides. This default motion is actuated by the configuration of the apparatus, with the preferred embodiment having a slanted pole and sloped panel support base.

Features of the invention include:

Display Variety and Versatility: The apparatus serves as a medium for displaying pre-printed messages, mounting bumper or other stickers, or for hand-applied messages.

On-Demand Display: The apparatus is quickly and easily affixed to or removed from a vehicle, allowing the message to be displayed periodically as desired.

Surface Friendly: The apparatus serves as the medium for application of message indicia so that vehicle surfaces are not marred or damaged.

Complementary Messages: Different messages can be displayed on each side of the message panel and on message panels on both sides of the vehicle, complementing or enhancing one another to create greater interest.

Fulltime Display: The message panel medium is rigid, making the mounted indicia viewable when the vehicle is at rest or in motion.

Durable Medium: The rigid medium is durable because it does not whip in the air/wind and is not susceptible to air/wind damage, increasing the useful life of the apparatus and mounted message.

Attention Enhancement: The rotating motion of the apparatus mounted on and extended away from the vehicle draws greater attention to the message.

Reduced Vibration and Noise: Apparatus stability is enhanced through a combination of configuring a rigid message panel attached to a relatively short mounting pole, positioning the panel with a profile at least partially below vehicle roof level, balancing material properties and dimensions to provide appropriate stiffness and quiet movement, and incorporating stops to dampen vibration and reduce noise.

Resiliency: The combination of stop dimensions, shape, material selection, and relative orientation with one another allow the panel to over-rotate toward the front of the vehicle during wind gusts, avoiding stress that could break the device.

Embodiments of the invention further comprise a method of displaying indicia on a motor vehicle comprising mounting a rotating message panel apparatus as described herein to a top edge of a window of a motor vehicle as described herein.

The terminology used herein is for the purpose of describing particular embodiments only and is not intended to be limiting of the invention. Unless specifically set forth herein, the terms "a," "an" and "the" are not limited to one element, but instead should be read as meaning "at least one." The terminology includes the words noted above, derivatives thereof and words of similar import. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. A device for displaying indicia thereon, the device comprising:

a base;

a pole affixed to or integral with and projecting upward from the base; and a panel hingedly attached to the pole, the panel having opposing sides for receiving indicia on one or both opposing sides;

wherein the base comprises a first base stop projecting from the base;

wherein the base comprises a second base stop projecting from the base;

wherein the base comprises a third base stop projecting from the base opposite the second base stop;

wherein, when the device is in a first configuration, the panel is rotatable about the pole between a first position and a second position, the panel contacts the first base stop when the panel moves to the first position to stop the panel from moving past the first position in a direction opposite from the second position, and the panel contacts the second base stop when the panel moves to the second position to stop the panel from moving past the second position in a direction opposite from the first position; and wherein, when the device is in a second configuration, the panel is rotatable about the pole between a third position and a fourth position, the panel contacts the first base stop when the panel moves to the third position to stop the panel from moving past the third position in a direction opposite from the fourth position, and the panel contacts the third base stop when the panel moves to the fourth position to stop the panel from moving past the fourth position in a direction opposite from the third position.

2. The device of claim 1, further comprising a biasing means;

wherein the biasing means biases the panel toward the first position when (a) the device is in the first configuration and (b) the panel is in the second position or between the first position and the second position; and wherein the biasing means biases the panel toward the third position when (a) the device is in the second configuration and (b) the panel is in the fourth position or between the third position and the fourth position.

3. The device of claim 1, further comprising a hollow tube affixed to or integral with the panel for receiving the pole to enable attachment of the panel to the pole.

4. The device of claim 3, wherein a reduced diameter area is defined in a portion of the pole adjacent a top end of the pole;

wherein a top end of the tube comprises a ledge closing off a portion of the top end of the tube; and wherein the ledge engages with the reduced diameter area of the pole to retain the panel in place attached to the pole.

5. The device of claim 1, wherein a surface of the base is angled such that the panel cooperates with the angled surface of the base to move the panel upward as the panel moves from the first position to the second position or from the third position to the fourth position; and wherein the upward movement of the panel biases the panel (a) toward the first position when the device is in the first configuration and the panel is in the second position or between the first position and the second position or (b) toward the third position when the device is in the second configuration and the panel is in the fourth position or between the third position and the fourth position.

6. The device of claim 1, wherein a panel stop projects downward from a bottom edge of the panel; and wherein the panel contacts the first, second, and third stops via the panel stop.

7. The device of claim 6, wherein the first base stop projects outward from the base.

8. The device of claim 1, wherein the base comprises a clip adapted to enable the device to be mounted to a top edge of a vehicle window.

9. The device of claim 8, wherein the pole is at an angle to the base such that the pole is adapted to be angled away from a centerline of the vehicle when the device is mounted to the vehicle window.

10. The device of claim 1, wherein a distal edge of the panel is tapered or thinned.

11. A device for displaying indicia thereon, the device comprising:

a base comprising a first base stop projecting from the base, a second base stop projecting from the base, a third base stop projecting from the base opposite the second base stop, and a clip adapted to enable the device to be mounted to a top edge of a vehicle window;

a pole affixed to or integral with and projecting upward from the base, a reduced diameter area being defined in a portion of the pole adjacent a top end of the pole;

a panel hingedly attached to the pole, the panel having opposing sides for receiving indicia on one or both opposing sides; and a hollow tube affixed to or integral with the panel for receiving the pole to enable attachment of the panel to the pole, a top end of the tube comprising a ledge closing off a portion of the top end of the tube;

wherein, when the device is in a first configuration, the panel is rotatable about the pole between a first position and a second position, the panel contacts the first base stop when the panel moves to the first position to stop the panel from moving past the first position in a direction opposite from the second position, and the panel contacts the second base stop when the panel moves to the second position to stop the panel from moving past the second position in a direction opposite from the first position;

wherein when the device is in a second configuration, the panel is rotatable about the pole between a third position and a fourth position, the panel contacts the first base stop when the panel moves to the third position to stop the panel from moving past the third position in a direction opposite from the fourth position, and;

wherein the panel contacts the third base stop when the panel moves to the fourth position to stop the panel from moving past the fourth position in a direction opposite from the third position;

wherein a surface of the base is angled such that the panel cooperates with the angled surface of the base to move the panel upward as the panel moves from the first position to the second position or from the third position to the fourth position;

wherein the upward movement of the panel biases the panel (a) toward the first position when the device is in the first configuration and the panel is in the second position or between the first position and the second position or (b) toward the third position when the device is in the second configuration and the panel is in the fourth position or between the third position and the fourth position; and wherein the ledge engages with the reduced diameter area of the pole to retain the panel in place attached to the pole.

12. The device of claim 11, wherein a panel stop projects downward from a bottom edge of the panel; and wherein the panel contacts the first, second, and third stops via the panel stop.

13. The device of claim 11, wherein the first base stop projects outward from the base.

14. The device of claim 11, wherein a distal edge of the panel is tapered or thinned.

15. The device of claim 11, wherein the pole is at an angle to the base such that the pole is adapted to be angled away from a centerline of the vehicle when the device is mounted to the vehicle window.

16. A method for displaying indicia on a motor vehicle, the method comprising:

(a) obtaining a device for displaying indicia thereon, the device comprising:

a base comprising a clip adapted to enable the device to be mounted to a top edge of a vehicle window;

a pole affixed to or integral with and projecting upward from the base; and a panel hingedly attached to the pole, the panel having opposing sides for receiving indicia on one or both opposing sides;

wherein the base comprises a first base stop projecting from the base;

wherein the base comprises a second base stop projecting from the base;

wherein the base comprises a third base stop projecting from the base opposite the second base stop;

wherein, when the device is in a first configuration, the panel is rotatable about the pole between a first position and a second position, the panel contacts the first base stop when the panel moves to the first position to stop the panel from moving past the first position in a direction opposite from the second position, and the panel contacts the second base stop when the panel moves to the second position to stop the panel from moving past the second position in a direction opposite from the first position;

wherein, when the device is in a second configuration, the panel is rotatable about the pole between a third position and a fourth position, the panel contacts the first base stop when the panel moves to the third position to stop the panel from moving past the third position in a direction opposite from the fourth position, and the panel contacts the third base stop when the panel moves to the fourth position to stop the panel from moving past the fourth position in a direction opposite from the third position; and (b) attaching the clip to the top edge of the motor vehicle window; and (c) positioning the panel such that the device is in the first configuration if the motor vehicle window is on a first side of the vehicle or positioning the panel such that the device is in the second configuration if the motor vehicle window is on a second side of the vehicle opposite from the first side.

17. The method of claim 16, wherein the device further comprises a hollow tube affixed to or integral with the panel for receiving the pole to enable attachment of the panel to the pole.

18. The method of claim 17, wherein a reduced diameter area is defined in a portion of the pole adjacent a top end of the pole;

wherein a top end of the tube comprises a ledge closing off a portion of the top end of the tube; and wherein the ledge engages with the reduced diameter area of the pole to retain the panel in place attached to the pole.

19. The method of claim 16, wherein a surface of the base is angled such that the panel cooperates with the angled surface of the base to move the panel upward as the panel moves from the first position to the second position or from the third position to the fourth position; and wherein the upward movement of the panel biases the panel (a) toward the first position when the device is in the first configuration and the panel is in the second position or between the first position and the second position or (b) toward the third position when the device is in the second configuration and the panel is in the fourth position or between the third position and the fourth position.

20. The method of claim 16, wherein a panel stop projects downward from a bottom edge of the panel; and wherein the panel contacts the first, second, and third stops via the panel stop.

21. The method of claim 20, wherein the first base stop projects outward from the base.

22. The method of claim 16, wherein a distal edge of the panel is tapered or thinned.

23. The method of claim 16, wherein the device further comprises a biasing means;

wherein the biasing means biases the panel toward the first position when (a) the device is in the first configuration and (b) the panel is in the second position or between the first position and the second position; and wherein the biasing means biases the panel toward the third position when (a) the device is in the second configuration and (b) the panel is in the fourth position or between the third position and the fourth position.

24. The method of claim 16, wherein the pole is at an angle to the base such that the pole is adapted to be angled away from a centerline of the vehicle when the device is mounted to the vehicle window.

* * * * *